US005842417A

United States Patent [19]

Kiefaber et al.

[11] Patent Number: 5,842,417

[45] Date of Patent: Dec. 1, 1998

[54] APPARATUS FOR PREVENTING CONDENSATION IN MACHINES PROCESSING A WEB OF MATERIAL

[75] Inventors: Drew E. Kiefaber, Newmarket; Jeffrey R. Rummler, Portsmouth, both of N.H.

[73] Assignee: Heidelberger Druckmaschinen AG, Heidelberg, Germany

[21] Appl. No.: 427,775

[22] Filed: Apr. 25, 1995

[51] Int. Cl.[6] ..... B41L 23/20

[52] U.S. Cl. ..... 101/424.1

[58] Field of Search ..... 101/148, 424.1, 101/216, 416

[56] References Cited

U.S. PATENT DOCUMENTS

| | | | |
|---|---|---|---|
| 4,089,193 | 5/1978 | Mitter | 101/424.1 |
| 4,308,042 | 12/1981 | Ecker | 62/82 |
| 4,905,596 | 3/1990 | Kobler . | |
| 5,024,155 | 6/1991 | Jahn . | |
| 5,085,142 | 2/1992 | Smith . | |
| 5,126,121 | 6/1992 | Weimer et al. | 423/412 |

FOREIGN PATENT DOCUMENTS

| | | |
|---|---|---|
| 481 801 | 10/1991 | European Pat. Off. . |
| 1 212 722 | 11/1970 | United Kingdom . |
| 2 268 121 | 1/1994 | United Kingdom . |

*Primary Examiner*—Ren Yan
*Attorney, Agent, or Firm*—Kenyon & Kenyon

[57] ABSTRACT

The present invention concerns an apparatus for preventing condensation in machines for processing web-like material, and in particular an apparatus for preventing condensation on the safety guard of a printing press. The apparatus includes components of a processing unit, and elements assigned to the components to maintain the surface temperature of the components above the dew point of the surrounding air.

21 Claims, 6 Drawing Sheets

APPARATUS FOR PREVENTING CONDENSATION IN MACHINES PROCESSING A WEB OF MATERIAL

BACKGROUND OF THE INVENTION

1. Field of the Invention

The present invention concerns an apparatus for preventing condensation in machines processing web-like material. More particularly, the present invention relates to an apparatus for preventing condensation on a safety guard in a printing press.

2. Description of the Related Art

From the state of the art, there is shown in United Kingdom Patent Application No. 2 268 121 a guard for safeguarding hazardous locations of a printing unit. This application shows a protective guard swivelable about a horizontal swivel shaft including a finger protection guard. Together with side protective guards, the finger protection guard is swivelable by remote control, covering clamping elements and cylinder bearers in the cylinder region of a printing unit.

Great Britain Patent Specification No. 1 212 722 discloses a safety device for rotating cylinders. A safety device which incorporates a switching elements is arranged in a danger zone in front of the nip between the cylinders and parallel to the cylinder axis. Upon actuation of the switching element, the current supply to driving motors of the cylinders is interrupted.

European Patent Application No. 0 481 801 discloses a flexographic printing unit. The printing unit may be combined in a line with a number of other units of a machine, each unit having inlet and outlet slots, printing unit cylinders, ink reservoirs, etc. The unit is contained within a housing into which a continuous stream of filtered and pressurized air is introduced, in order to establish and maintain a pressure within the housing at a level which is higher than atmospheric pressure, including the pressure in an escape vent. The excess pressure within the housing ensures that no dust or fiber particles may enter the printing unit to contaminate the ink or to foul the various roll surfaces.

U.S. Pat. No. 4,905,596 discloses a combined cleaning and safety device for printing unit cylinders. As a safety measure, a finger guard strip is provided in advance of the nip between rotating cylinders. The safety guard or rail has an angled shape or, in cross section, a partially circular or typically semi-circular shape. The guard or rail is slidably supported by levers, so as to be placed out of position, away from the nip, when the machine is stopped.

U.S. Pat. No. 5,024,155 discloses a finger protecting element for a cylinder nip. This finger protecting element is pivotally mounted at an end of a shaft having a guide surface on a side facing one of the cylinders. The guide surface begins at the other and free end of the finger protective element in the vicinity of the nip.

U.S. Pat. No. 5,085,142 describes a device which directs air near an inker for regulating temperature.

SUMMARY OF THE INVENTION

In the technical field of the present invention, e.g., in print shops and press testing facilities etc., there has been encountered the problem that on high-speed machines, condensation of humidity occurs on those safety elements vital to protecting the press operating staff. Condensation on a guard can be in the form of droplets on the surfaces which can collect to form drops dripping either onto the surface of the web-type material to be printed upon or into the printing unit, thereby causing print defects and other undesirable conditions. Condensation below the material web can cause print defects as well, when droplets drip onto surfaces of vibrator rollers or the like of a lower printing unit. On other printing unit components such as shields, rails, frame parts or tail tuckers, condensation may also occur in the form of droplets dripping on the web or on components of the ink train, thus posing a risk for maintaining print quality.

In view of the state of the art and the technical problems encountered, as outlined above, it is one object of the present invention to prevent defects on printed material due to condensation. It is another object of the present invention to maintain those surfaces of components where condensation is likely to occur at a temperature level above the dew point.

According to the present invention, an apparatus for preventing condensation in machines for processing web-like material includes components arranged in a processing unit, where the components have a mechanism to alter temperature differences between the surfaces of the components and the surrounding air. This arrangement offers the advantage that no additional equipment has to be added to the printing unit if, for example, the hollow interior of a nip guard is to be charged with a medium, such as water, oil, air or a mixture thereof having suitable heat transfer properties. The interior could also be charged with any pure fluid with appropriate heat transfer properties, and in particular a glycol or other antifreeze-type compound, which compounds are frequently mixed with water in printing presses to reduce corrosion. A closed loop can be established among components for which the surface temperature has to be kept above the dew point, which includes a pipe system with supply and recirculating portions and a reservoir. The reservoir includes a heat exchange element and a pumping and stirring device for maintaining a uniform temperature distribution within the reservoir. Through a manually-operable or remotecontrollable flow rate control mechanism, such as actuating valves, the temperature level in the components, like nip guards, cross bars, pans, shields, vibrator rollers, can be adjusted accordingly.

Instead of using a medium such as water, oil, or air etc., the components could be heated electrically, using induction coils or various adjustable electrical resistance elements within the components, which are slightly heated.

For reducing the humidity in the printing unit environment, an increase of air circulation as well as a general dehumidification are conceivable aspects of the invention.

BRIEF DESCRIPTION OF THE DRAWINGS

The foregoing and other features of the present invention will become apparent to those skilled in the art upon reading the following description of preferred embodiments of the invention in view of the accompany drawings, wherein.

DETAILED DESCRIPTION OF THE INVENTION

Figure 1:
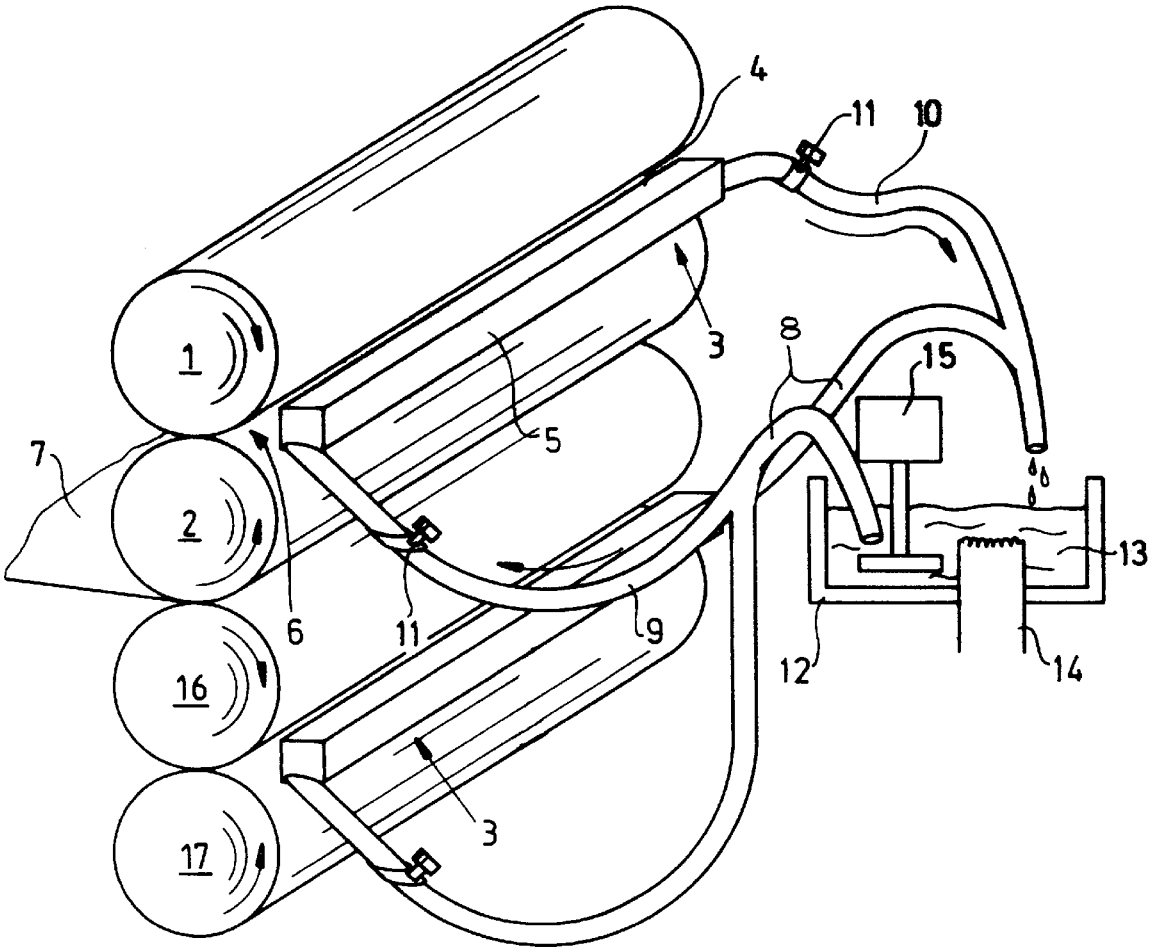
FIG. 1 shows a nip guard incorporated into a closed circulating system of a medium.

FIG. 1 shows an upper cylindrical body 1 and lower cylindrical body 2 of a printing unit. Between two first upper and lower printing unit cylinders 1, 2 and two second upper and lower printing unit cylinders 16, 17 a web of material 7 is printed on both sides thereof. A nip guard 3 protecting the press operator from being injured has surfaces indicated by 4 and 5. The nip guard 3 is connected to a pipe system 8 having a supply portion 9 as well as a recirculation portion 10, both of which are connected to a reservoir 12. Within the reservoir 12 a medium 13 is kept at a constant temperature level. The medium 13 within the reservoir 12—such as water, oil, air or a mixture of other components—is stirred by a pumping device 15, thereby generating a uniform temperature distribution in the medium 13 within the reservoir 12. In the event that the temperature level of the medium 13 being recirculated through the reservoir 12 via the recirculation portion 10 of the pipe system 8 has changed significantly, the temperature of the medium 13 can be controlled via a heat exchanger 14 assigned to the reservoir 12. The pipe system 8 includes flow control devices 11 to adjust the flow of heating medium 13 to the component 3.

In the embodiment shown in FIG. 1 the component is a nip guard 3 having a hollow interior. But into a closed loop of similar configuration other components, such as shields, crossbars, frames, etc. of a printing unit can be integrated to prevent condensation drops being formed thereon which spoil the print quality.

Figure 2:
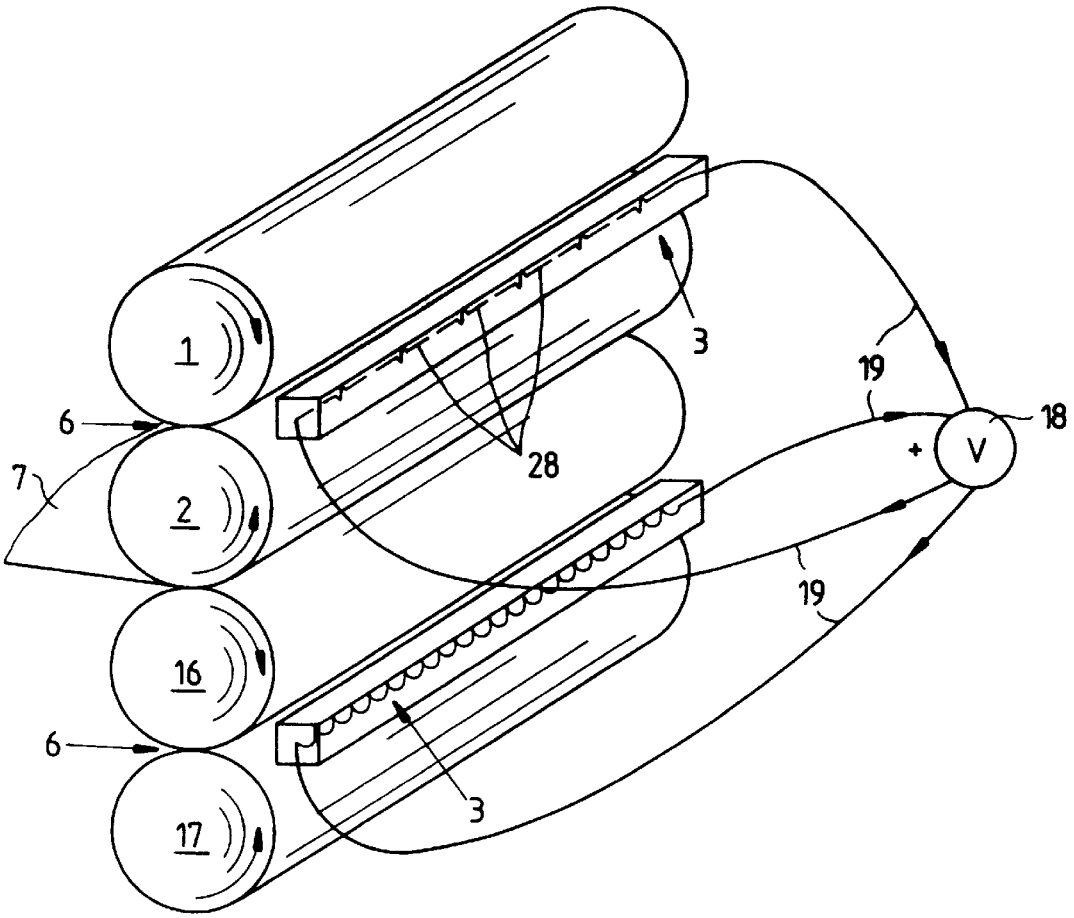
FIG. 2 shows electrical resistance elements being integrated in a guard.

FIG. 2 shows electrical resistance elements being integrated into a guard. In this embodiment a nip guard 3 is assigned to the nip 6 between the first upper and lower printing unit cylinders 1, 2 and the second upper and lower printing cylinders 16, 17, respectively. Each of said nip guards 3 has electrical resistance elements 28 being connected via wires 19 to a power source 18, or can include a single resistance element which extends along the length of the nip guard 3. Thus, the temperature of the nip guard 3 is maintained above the ambient dew point, preventing condensation. In addition to nip guard 3 as shown in FIG. 2, shields, frame parts, tail tuckers and the like can be equipped with the electrical resistance elements 28 connected to a power source 18.

Figure 3:
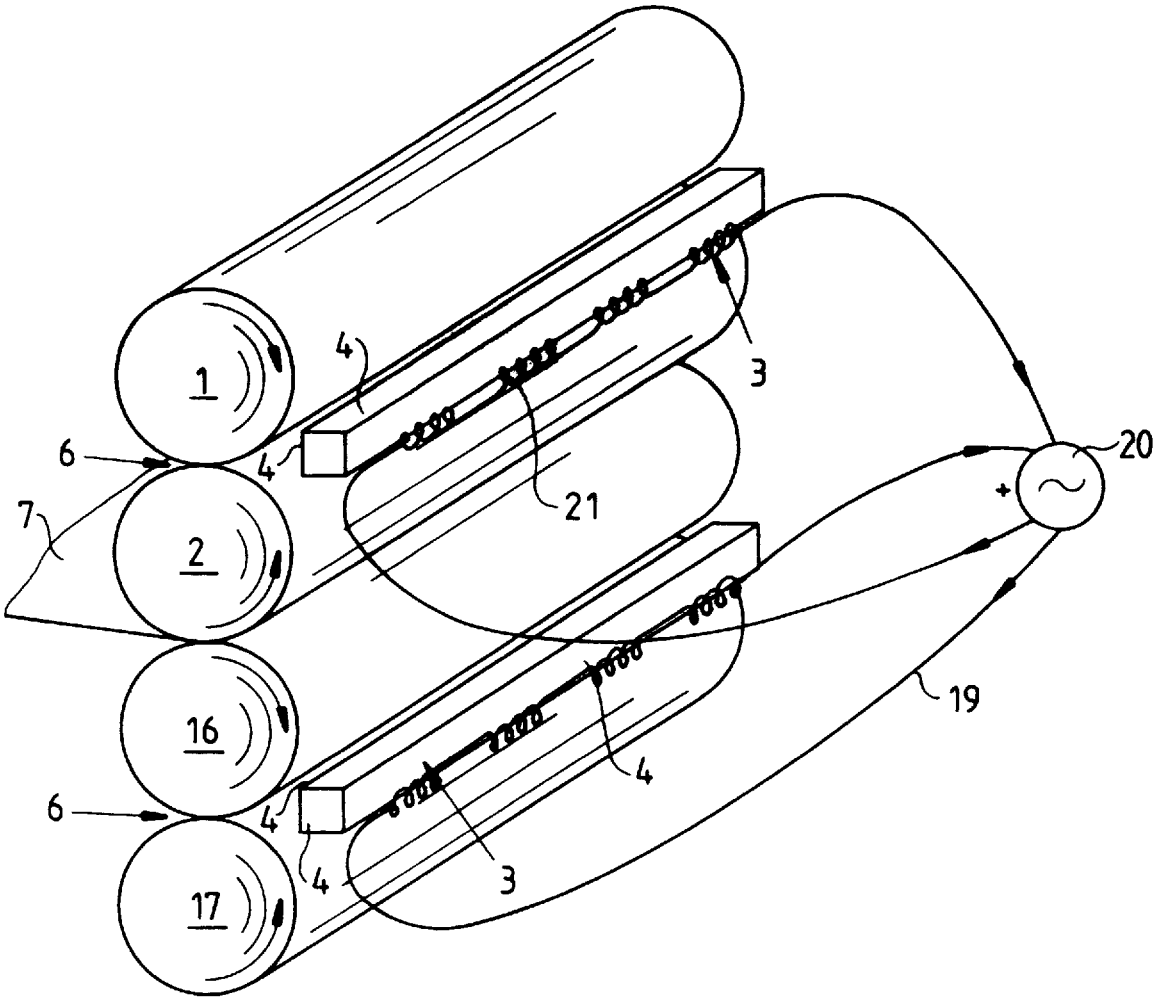
FIG. 3 shows an embodiment having alternating current generator.

FIG. 3 illustrates an alternative embodiment using an alternating current generator. In this embodiment nip guards 3 having induction coils 21 are assigned to each of the nips 6 between the cylinder surfaces 1, 2 and 16, 17, respectively. The induction coils 21 are connected via wires 19 to an alternating current generator 20. The alternating current flowing in the induction coils 21 induces eddy-currents in the nip guards 3 or other components where condensation is likely to occur, to alter the temperature difference between said components surfaces and the surrounding air.

Figure 4:
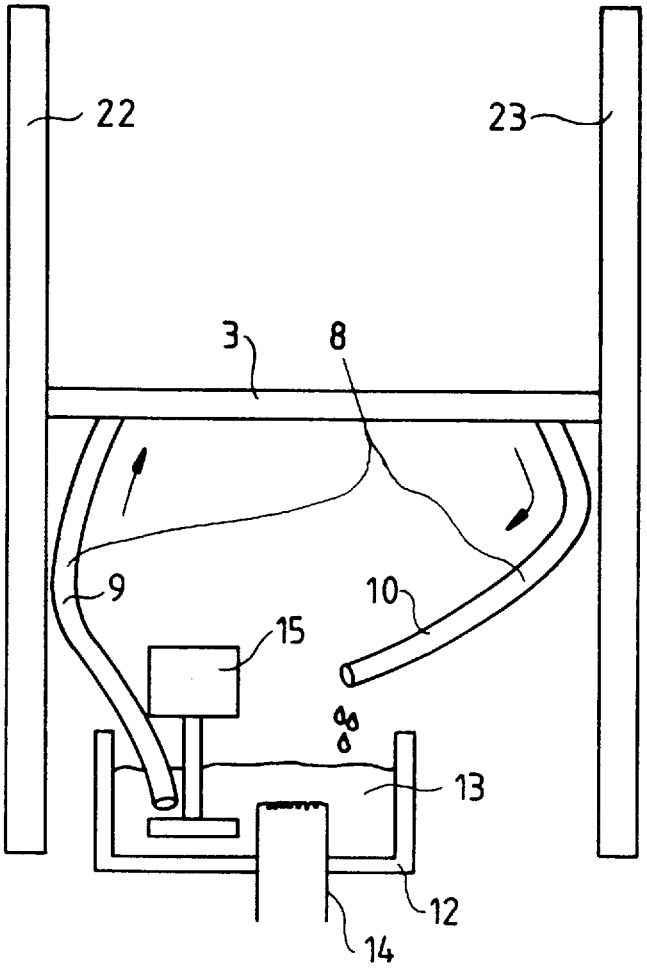
FIG. 4 is an embodiment having a crossbar and side frames integrated in a circulation loop of a medium.

FIG. 4 shows a crossbar being integrated into the circulation loop of the medium 13. Instead of nip guard 3 as disclosed in the embodiment of the invention according to FIG. 1, a crossbar 3 or even the side frames 22, 23 can be integrated into the pipe system 8 circulating the medium 13.

Figure 5:
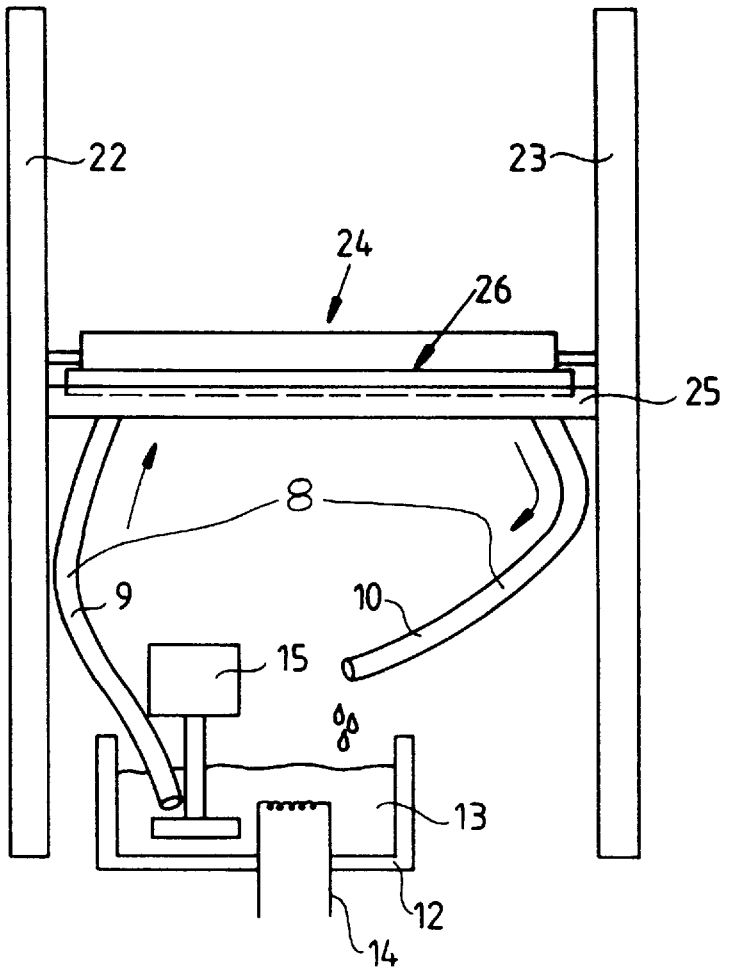
FIG. 5 shows a dampening system having pans which are connected to a circulating fluid piping system.

FIG. 5 shows an embodiment having a dampening system being integrated into a circulation loop. The dampening system 24 comprises an outer pan 25 and an inner pan 26. The outer pan 25 is integrated into the pipe system 8 allowing the medium 13 to flow through the outer pan 25, thus maintaining its temperature above the dew point.

Figure 6:
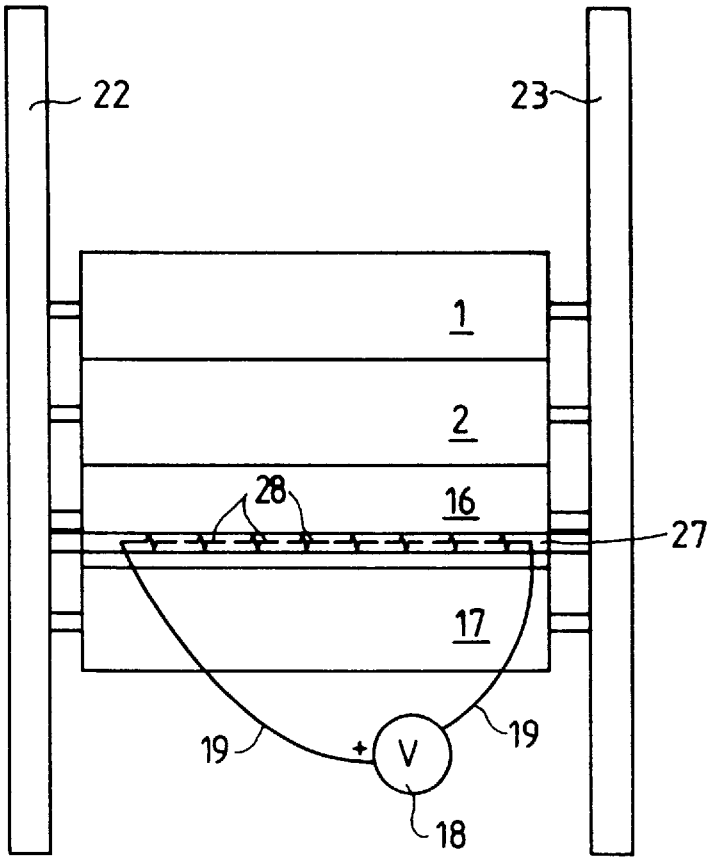
FIG. 6 is an embodiment having a blanket washing device with electrical heating elements.

A further embodiment, illustrated in FIG. 6, shows a blanket washing device 27 which is equipped with electrical resistance elements 28 connected to a power source 18 via wires 19. The power loss in the resistance elements 28 heats the blanket washing device 27 thus maintaining its surface temperature above the dew point, to prevent condensation.

We claim:

1. An apparatus for preventing condensation in machines processing a web-like material, comprising:

at least one component arranged within a processing unit, said at least one component having at least one surface in contact with and surrounded by ambient air; and a heating element, said heating element increasing a temperature of said at least one surface of said at least one component, said heating element reducing a difference between said temperature of said at least one surface of said at least one component and a temperature of said ambient air surrounding said at least one component.

2. The apparatus of claim 1, wherein:

said heating element maintains said temperature of said at least one surface of said at least one component above an ambient dew point of said ambient air surrounding said at least one surface of said at least one component.

3. The apparatus of claim 1, wherein:

said at least one component comprises a hollow interior through which a heating fluid flows.

4. The apparatus of claim 3, further comprising:

a pipe system comprising a supply portion and a recirculation portion, said heating fluid circulating through said hollow interior and said pipe system.

5. The apparatus of claim 4, wherein:

said pipe system comprises a reservoir, a heat exchanger and a pump.

6. The apparatus of claim 4, wherein:

said pipe system comprises a flow controller, said flow controller controlling said flow of said heating fluid.

7. The apparatus of claim 3, wherein:

said heating fluid is water.

8. The apparatus of claim 3, wherein:

said heating fluid is oil.

9. The apparatus of claim 3, wherein:

said heating fluid is air.

10. The apparatus of claim 3, wherein:

said heating fluid is a mixture of fluids.

11. The apparatus of claim 3, wherein:

said heating fluid is a pure fluid.

12. The apparatus of claim 3, wherein:

said heating fluid is an antifreeze fluid.

13. The apparatus of claim 1, wherein:

said at least one component comprises a nip guard, said processing unit comprising cylinders rotating adjacent one another, said nip guard being located adjacent an area between said rotating cylinders.

14. The apparatus of claim 1, wherein:

said at least one component comprises a frame.

15.The apparatus of claim 14, wherein:

said heating element comprises at least one electrical resistance element.

16. The apparatus of claim 14, wherein:

said heating element comprises at least one inductive coil.

17. The apparatus of claim 1, wherein:

said at least one component comprises a crossbar.

18. The apparatus of claim 1, wherein:

said at least one component comprises a shield.

19. The apparatus of claim 1, wherein:

said heating element is operated electrically.

20. The apparatus of claim 1, wherein:

said at least one component comprises a blanket washing device.

21. The apparatus of claim 1, wherein:

said at least one component comprises a dampening system.

* * * * *